US005323852A

United States Patent [19]

Cornette et al.

[11] Patent Number: 5,323,852

[45] Date of Patent: Jun. 28,.1994

[54] TORQUE LIMITER FOR AUGER GRAVEL PACK ASSEMBLY

[75] Inventors: H. Mitchell Cornette; Robert K. Bethel; Steven R. Hayter, all of Houston; John V. Salerni, Kingwood, all of Tex.

[73] Assignee: Atlantic Richfield Company, Los Angeles, Calif.

[21] Appl. No.: 971,527

[22] Filed: Nov. 3, 1992

[51] Int. Cl.[5] ..... E21B 43/00

[52] U.S. Cl. ..... 166/51; 166/117.7

[58] Field of Search ..... 166/51, 278, 117.7, 166/330, 236, 377, 378, 381

[56] References Cited

U.S. PATENT DOCUMENTS 4,239,083 12/1980 Silberman et al. ..... 166/117.7

5,137,087 8/1992 Szarka et al. ..... 166/117.7 X

*Primary Examiner*—Thuy M. Bui

*Attorney, Agent, or Firm*—Michael E. Martin

[57] ABSTRACT

An auger gravel pack screen or other wellbore device is driven by a workstring which includes a torque-limiting device interposed therein to limit the maximum torque exerted on the screen during augering into a gravel packing in a well bore. The torque-limiting device includes driving and driven mandrels with removable shear pin support parts connected to the mandrels, respectively, and supporting plural shear pins through which driving torque is exerted on the device. An alternate embodiment includes a slip clutch with cooperating lobed clutch members. An axially translatable nut is disposed in a fluid-filled chamber between the mandrels and is operable to permit controlled rotation of the mandrels relative to each other when the limit torque is exceeded to absorb torsional deflection energy built up in the workstring without damaging the workstring or the gravel pack screen.

25 Claims, 4 Drawing Sheets

TORQUE LIMITER FOR AUGER GRAVEL PACK ASSEMBLY

BACKGROUND OF THE INVENTION

1. Field of the Invention

The present invention pertains to a torque limiting and torsional deflection energy absorbing device for use in installing wellbore devices, such as an auger gravel pack assembly, in a well.

2. Background

So-called auger-type gravel pack assemblies are becoming increasingly attractive in well-completion operations. In an auger-type gravel pack installation, the gravel packing is preinstalled in the wellbore, and a tubular gravel pack screen is provided with auger flights to provide for rotatably augering the screen into its working position in the gravel packing. The process of rotatably augering the gravel pack screen into its working position is usually carried out by connecting the auger gravel pack assembly to an elongated drill stem or so-called "workstring" which is rotatably driven from the surface by conventional drill stem rotation equipment such as a rotary table or a so-called power swivel.

One consideration required in an auger gravel pack installation, as well as in certain other wellbore operations, is control over the torque exerted by the workstring and its associated drive mechanism to prevent damage to the auger gravel pack assembly. In this regard it has been considered important to develop means for limiting the torque exerted on an auger gravel pack assembly to prevent damage to the assembly from overtorque during the augering process. The present invention is directed to improved means for controlling or limiting the torque exerted on an auger gravel pack assembly as well as absorption of the torsional deflection recoil encountered when the limit torque is reached.

SUMMARY OF THE INVENTION

The present invention provides an improved auger gravel pack screen installation system including a unique torque limiting device.

In accordance with one aspect of the present invention there is provided a unique device for installation in a workstring for limiting the torque exerted on an auger gravel pack assembly during installation thereof, which device is provided with driving and driven members which are interconnected by shear pins or a slip clutch adapted to limit the torque exerted on the device and the portion of the workstring which is connected to an auger gravel pack screen.

In accordance with another aspect of the present invention, there is provided a torque-limiting device for use in installing an auger gravel pack screen which also includes energy absorption means for absorbing the torsional deflection energy of an elongated tubular drill stem or workstring during installation of the auger gravel pack assembly.

Further in accordance with the present invention, there is provided an auger gravel pack installation system which includes a device which is adapted to limit the torque exerted on a workstring and an auger gravel pack assembly, which device includes easily replaceable elements which are subject to shear forces and the shearing action encountered in shearing frangible members such as one or more cylindrical shear pins. The torque limiting device advantageously includes an energy absorption mechanism, is easily disassembled for replacement of the shear pins and, if needed, replacement of the parts which support the shear pins directly and which move relative to each other when the shear pins fail.

Still further in accordance with the present invention, a torque-limiting device is provided for installing auger gravel pack screens and other wellbore tools which includes cooperating driving and driven clutch members which are yieldably biased into engagement with each other with, preferably, conical or Belleville type washer springs and wherein the clutch members have cooperating cam lobes which are cooperable to provide for rotationally slipping one clutch member with respect to the other at a predetermined torque exerted on the device. The clutch members are preferably biased into engagement by a piston which is biased by pressure fluid which also serves as a lubricating and energy-absorbing fluid for an energy-absorbing device.

The device of the present invention is easily adapted for inter positioning in a drill stem or workstring at several preferred locations, including just below a torque input device, such as a power swivel or rotary table, or directly above the installation equipment which is used to install a gravel pack assembly and release the gravel pack assembly from the workstring.

Although the torque-limiting and energy-absorbing devices of the present invention are particularly useful for limiting torque exerted on an auger gravel pack assembly, the devices may be used in conjunction with other wellbore operations such as coring, side tracking, snubbing and fishing operations which require rotation of a drill or "work" string and which advantageously could utilize a torque-limiting device to prevent over torquing or damaging wellbore tools or devices during such operations. Those skilled in the art will recognize and further appreciate the above-described advantages and features of the present invention together with other superior aspects thereof upon reading the detailed description which follows in conjunction with the drawing.

DESCRIPTION OF A PREFERRED EMBODIMENT

Figure 1:
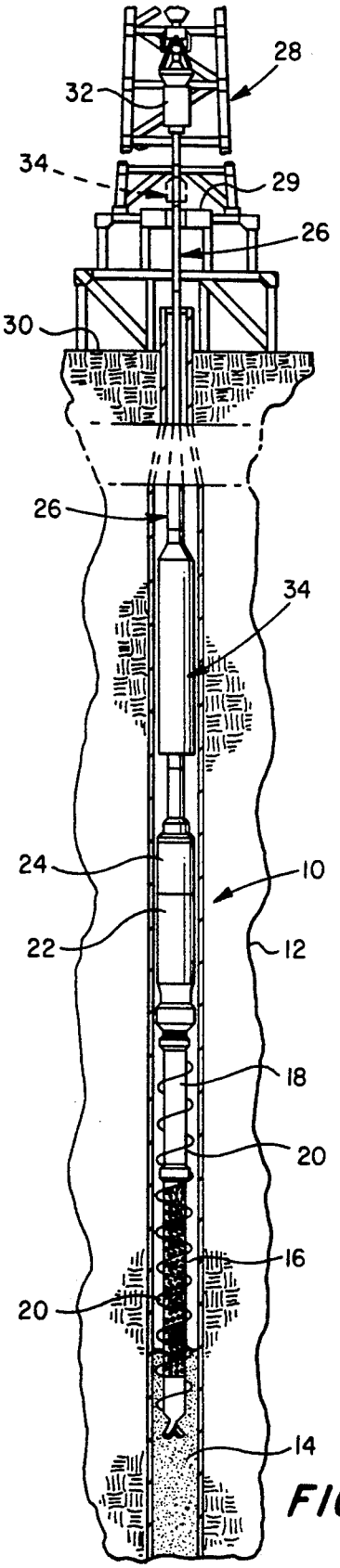
FIG. 1 is a longitudinal central section view, in somewhat schematic form, of a well showing installation of an auger gravel pack assembly including the unique torque-limiting and energy-absorption device of the present invention.

In the description which follows, like parts are marked throughout the specification and drawing with the same reference numerals, respectively. The drawing figures are not necessarily to scale in the interest of clarity and conciseness.

Referring to FIG. 1, there is shown in somewhat schematic form a cased well 10 penetrating an earth formation 12. A portion of the well 10 has been prefilled with gravel packing 14 in a conventional manner and in accordance with an improved gravel pack assembly and a method of installation as described in U.S. Pat. No. 5,036,920 issued Aug. 6, 1991 to H. M. Cornette, et al and assigned to the assignee of the present invention. In accordance with the gravel pack well completion and auger screen assembly described in the '920 Patent, and as shown in FIG. 1, an auger-type gravel pack screen 16 is in the process of being augered into the gravel packing 14. The screen 16 is part of an auger gravel pack assembly including a blank pipe section 18 which includes auger flights 20 thereon also. The blank pipe section 18 is connected to a hook-up nipple assembly 22 which is connected to a conventional running tool 24 such as a type made by Baker Sand Control, Division of Baker Hughes, Inc., Houston, Tex. The gravel pack assembly 16, 18 together with the hook-up nipple 22 and the running tool 24 are connected to an elongated tubular drill stem or so-called "workstring", generally designated by the numeral 26. The workstring 26 extends from the well 10 up to a conventional drill rig 28 disposed on the surface 30. The upper end of the workstring 26 is illustrated as being connected to a conventional power swivel 32 which is adapted to rotatably drive the workstring to effect rotation of the auger gravel pack screen 16 to auger the screen into the gravel packing 14. Alternatively, the workstring 26 may be rotatably driven by a conventional rotary table, indicated at numeral 29 in FIG. 1.

In order to limit the maximum torque applied to the gravel pack screen 16 and the blank pipe section 18, as well as the running tool 24, a unique torque-limiting device 34 is shown interposed in the workstring 26 above the running tool 24. Although the device 34 may be installed in the workstring 26 just above the running tool 24, another preferred location of the device 34 may be at the upper end of the workstring, as indicated by the alternate position of the device, also shown by the numeral 34 and interposed in the workstring between the rotary table 29 and the power swivel 32. Advantages derived from locating the torque-limiting device in the workstring 26 in the alternate position shown in FIG. 1 and interposed in the workstring directly below the power swivel 32 will be further described in detail herein below. The description and illustration of the rotary table 29 and the power swivel 32 in FIG. 1 is for reference purposes. In conventional operations only one of these torque-exerting devices would be used in effecting rotation of the workstring 26. Moreover, if the rotary table 29 was the source of torsional effort on the workstring 26, the torque-limiting device 34 would, of course, be desirably located in the workstring 26 between the rotary table and the auger gravel pack screen 16. Again, the preferred location of the device 34 might be directly below the rotary table 29 so that access to the device would not require withdrawal of a substantial part of the workstring 26 entirely from the well 10 in the event that the device was actuated to prevent over-torquing the auger gravel pack screen 16 during installation thereof.

Figure 3:
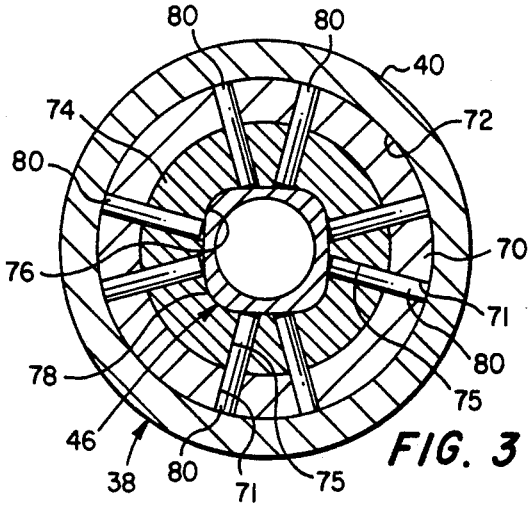
FIG. 3 is a section view taken along line 3—3 of FIG. 2.
Figure 4:
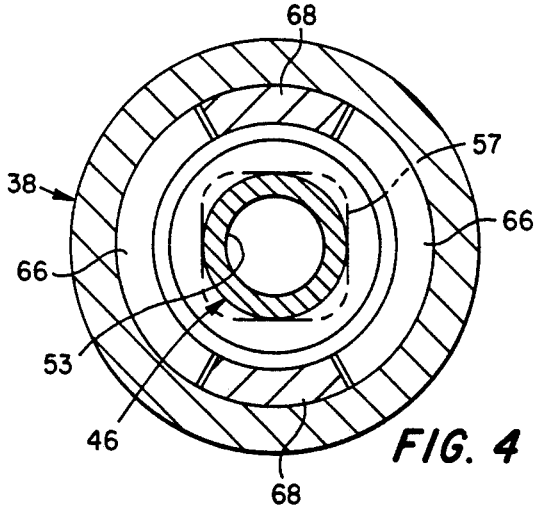
FIG. 4 is a section view taken along line 4—4 of FIG. 2.
Figure 2:
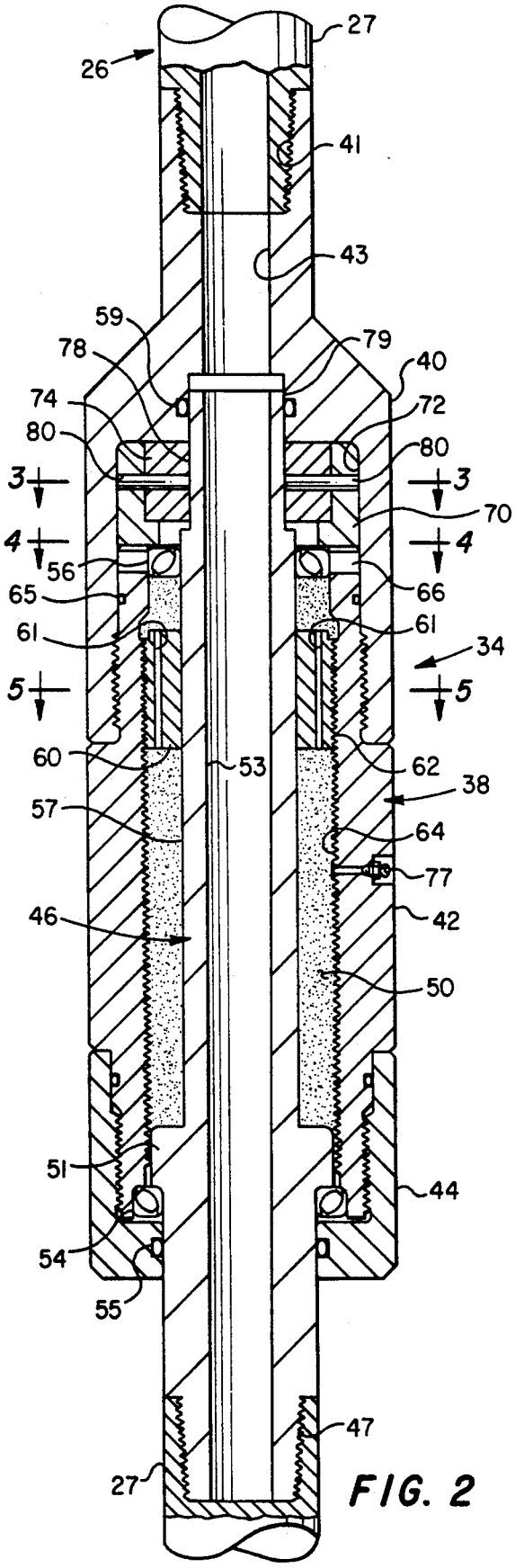
FIG. 2 is a longitudinal central section view of one embodiment of the torque limiter device.

Referring now to FIGS. 2, 3, and 4, the torque-limiting device 34 is shown interposed in the workstring 26 threadedly connected to members 27 of the workstring 26, as illustrated. Referring to FIG. 2, the torque-limiting device 34 includes a driving mandrel 38 which is made up of threadedly-connected members 40, 42, and 44. The device 34 also includes an inner or driven mandrel member 46, a major portion of which is generally concentrically disposed in the outer mandrel 38. The mandrel member 40 is provided with conventional internal or box threads 41 at its upper end for connection to the workstring 26, and the inner mandrel 46 is provided with conventional pin threads 47 at its lower end for connection to the workstring 26 also. An annular chamber 50 is formed between the mandrels 38 and 46 and, in particular, primarily between the mandrel 46 and the outer mandrel member 42 and is adapted to be filled with a suitable fluid such as machine grease or lubricating oil. The mandrels 38 and 46 are adapted for rotation relative to each other on suitable spaced-apart rolling element bearings 54 and 56 and are provided with coaxial fluid conducting passages 43 and 53 formed therein.

The chamber 50 is substantially delimited at its opposite ends by a collar portion 51 on the mandrel 46 and by the bearing 56. However, lubricating fluid is flowable within all of the space between the mandrels 38 and 46 between opposed seals 55 and 59. A seal 65 also prevents fluid leakage between members 40 and 42.

Figure 5:
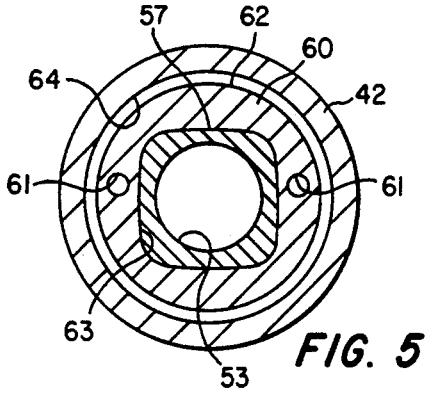
FIG. 5 is a section view taken along line 5—5 of FIG. 2.

A substantial part of the inner mandrel 46 between the bearings 54 and 56 has a generally square shaped transverse configuration, indicated by the numeral 57. The configuration or shape of the section 57 is illustrated in FIGS. 4 and 5. An externally threaded nut 60 provided with a bore 63 conforming to the shape of the mandrel section 57. The nut 60 is slidably disposed on the section 57 and is provided with external threads 62 which cooperate with threads 64 formed on the outer mandrel member 42 whereby the nut 60 may move axially through the chamber 50 in response to rotation of the mandrel 38 relative to the mandrel 46 in a manner to be described in further detail herein. One or more elongated passages 61, FIGS. 2 and 5, extend through the nut 60 to allow grease to flow within the chamber 50 from one side of the nut 60 to the other as it moves through the chamber in response to rotation of the mandrel 38 relative to the mandrel 46.

The upper end of the mandrel member 42 viewing FIG. 2, is provided with two axially projecting drive lugs 66, see FIG. 4 also, which are driveably engaged with cooperating axially projecting lugs 68 formed on a shear pin support part 70. The part 70 is formed as a generally cylindrical ring which fits within a recess 72 formed in the mandrel member 40. The inner mandrel 46 has disposed thereon a second shear pin support part 74 which has a generally square-shaped bore 76 formed therein, see FIG. 3. The shear pin support part 74 is disposed on a cooperating square-shaped portion 78 of the inner mandrel 46 which is of slightly reduced dimensions as compared with the square cross-sectional shaped portion 57 of the mandrel 46, as shown in FIGS. 2 and 3. A cylindrical distal shaft portion 79, FIG. 2, provides a seal surface for the seal 59. The shear pin support part 74 is journaled within the generally cylindrical ring-shaped shear pin support part 70. Each of the parts 70 and 74 is provided with a plurality of generally radially extending pin bores 71 and 75, respectively, for journaling shear pins 80. The pins 80 are captive in the bores 71, 75, when the device 34 is assembled in the condition shown in the drawing figures.

The operation of the device 34 will now be briefly described. In normal operation torque exerted on the mandrel 38 or 46 will transfer to the other mandrel through the shear pin support parts 70 and 74 and the shear pins 80 since the part 74 is non-rotatably secured on the mandrel 46 and the part 70 is non-rotatably secured to the mandrel member 42 by way of the cooperating drive teeth 66 and 68. When the torque exerted on the device 34 exceeds the shear strength of the pins 80, they will shear to permit rotation of the member 70 relative to the member 74. However, under the aforementioned conditions of failure of the pins 80, the tendency for the mandrel 38 to rotate relative to the mandrel 46 will cause the nut 60 to translate axially within the chamber 50 since the nut is non-rotatable but axially slidable along the mandrel 46.

As the nut 60 moves axially within the chamber 50, fluid is forced through the passages 61 from one part of the chamber to the other and this action will absorb the energy of the torsional deflection or "wind up" of the workstring 26 at the time of failure of the shear pins 80. Accordingly, a controlled relaxation of the elastic torsional deflection which may have built up in the workstring 26 is provided so as to prevent damage to the workstring or the auger gravel pack screen 16 and to prevent loosening or complete unthreading of the connections between sections of the workstring 26 and the components of the gravel pack assembly. The nut 60 is initially positioned in the chamber 50 along the mandrel 46 in accordance with the position of the torque-limiting device 34 in the workstring, the "hand" of the threads 62 and 64 and the direction of rotation of the workstring when it is applying torque to auger the gravel pack screen 16 into the gravel pack 14 so that, upon failure of the pins 80, the nut 60 will be permitted to travel substantially the length of the chamber 50 to transfer the afore-mentioned fluid from one side of the nut to the other and to absorb the energy of the elastic torsional deflection of the workstring 26.

As mentioned previously, a preferred location of the device 34 is in the alternate position shown in FIG. 1, above the rotary table 29, when the workstring 26 is being torsionally driven by a power swivel such as the swivel 32. In this position of the device 34 the torsional recoil of the workstring 26 and the gravel pack assembly including the auger gravel pack screen 16, the blank pipe section 18, the nipple 22, and the running tool 24 will be controlled as the energy of the torsional deflection of the workstring including these components will be absorbed by the dashpot effect caused by translation of the nut 60.

Moreover, once a torsional limit has been reached and the pins 80 shear to prevent over-torquing the workstring 26 and the auger gravel pack assembly, it is necessary to replace the pins 80. In this regard if the device 34 is located on the surface, it is easier to gain access to the device 34 to disconnect the member 40 from the member 42, remove the parts 70 and 74 from the device 34 and replace the set of pins 80 with a new set of pins. The parts 70 and 74 may then be replaced to their positions shown in FIG. 2 and the device 34 reassembled as part of the workstring 26 for continued work to auger the screen 16 into its final working position. If the pin support parts 70 and 74 have been damaged as a result of shearing of the pins 80, these parts may be easily replaced without having to replace major components of the torque limiter device 34. Moreover, the torque limit setting of the device 34 may be controlled by the number of pins 80 which are inserted in the respective sets of cooperating bores 71, 75 or, alternatively, by the strength of the material of which the pins 80 are made.

Although one preferred location of the device 34 is directly below the torque driver such as the power swivel 32 or the rotary table 29, the location of the device shown in FIG. 1 directly above the running tool 24 has advantages in that there is a substantially reduced tendency for the auger gravel pack screen 16 and the components connected thereto between the gravel pack 14 and the device 34 to rotate in a direction which would auger the screen out of the gravel pack in reaction to built-up torsional deflection at the condition of failure of the shear pins 80.

Figure 6:
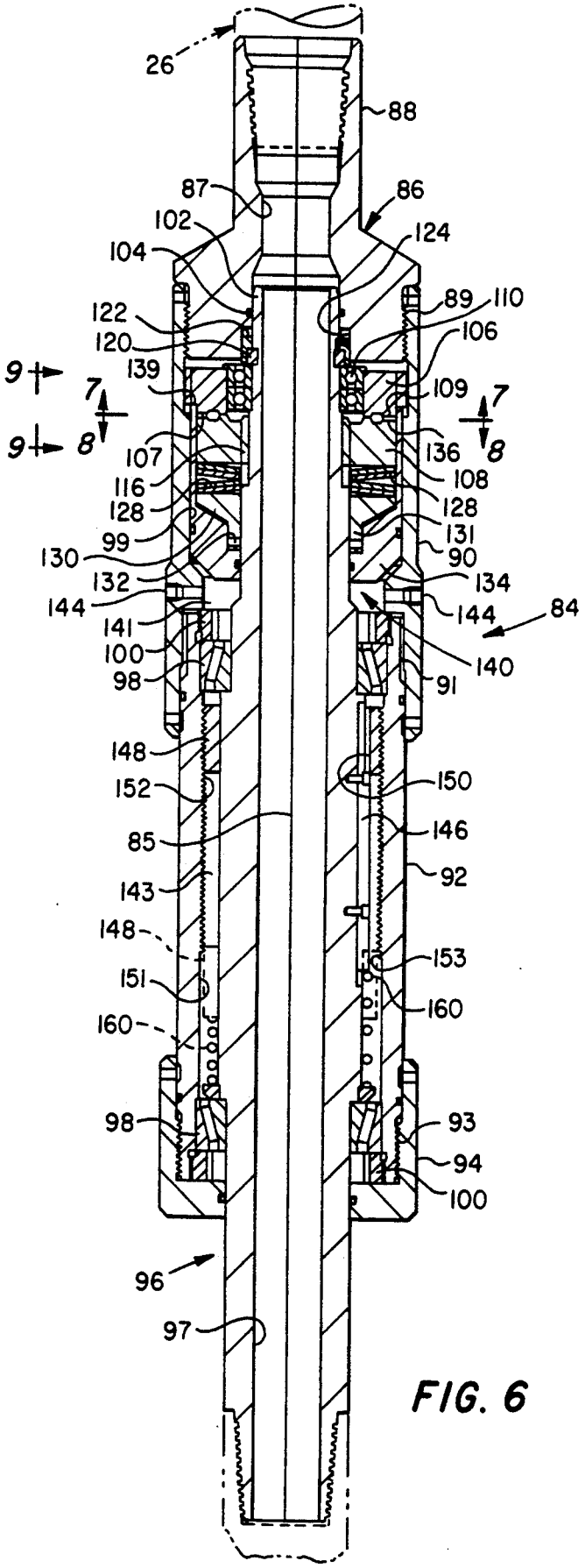
FIG. 6 is a longitudinal central section view of an alternate embodiment of the torque-limiting and energy-absorbing device.

Referring now, primarily, to FIG. 6, there is illustrated an alternate embodiment of a torque-limiting and energy-absorption device in accordance with the present invention, generally designated by the numeral 84. The device 84 is adapted to be interposed in the work string 26 in either of the places illustrated and described for the torque-limiting device 34. However, as indicated previously, if the energy-absorption mechanism of either of the devices 34 or 84 is utilized, a preferred location for the device 84, as well as the device 34, is to be interposed in the drillstring or work string near the surface and between the torque driving means and the driven wellbore device or tool, such as the auger gravel pack assembly, which is to be protected from over torque. The device 84 includes a driving mandrel 86 adapted to be connected to the work string 26 and including a member 88 which is operable to be threadedly connected to a cylindrical sleeve member 90 at interfitting threads 89. The driving mandrel 86 further includes a second sleeve member 92 which is threadedly connected to the member 90 at interfitting threads 91. A fourth member 94 forms an end cap for the mandrel 86 and is threadedly connected to the member 92 at cooperating threads 93.

The device 84 further includes an inner or driven mandrel 96 having an elongated central passage 97 extending therethrough and cooperable with a central passage 87 formed in the mandrel member 88 for conducting fluids through the device 84. The mandrel 96 is adapted for rotation with respect to the mandrel 86 on suitable spaced-apart, opposed, tapered roller bearing assemblies 98 mounted on the mandrel 96 and, each, retained in the sleeve member 92 by suitable bearing retainer nuts 100 threadedly secured to the sleeve member 92 in a conventional manner. The inner mandrel 96 has an upper distal end portion 102 which is disposed in a cooperating bore formed in the member 88. A fluid seal 104 is disposed on the member 88 and is operably engaged with the distal end portion 102 to prevent fluid from entering or leaving a cavity within the device 84 which contains a unique torque limiting coupling or clutch described hereinbelow.

The torque-limiting clutch is characterized by driving and driven clutch members 106 and 108 which are operably interengaged with each other to transmit torque between the mandrel 86 and the mandrel 96 but are also operable to rotate or slip relative to each other at a predetermined torque to allow the mandrel 86 to rotate relative to the mandrel 96. The driving clutch member 106 is supported on a double row ball bearing assembly 110 which is supported on the inner mandrel 96. The bearings 110 are retained on the mandrel 96 by a split cylindrical retaining ring 120, FIG. 6, which fits in a cooperating groove in the mandrel 96. A retaining collar 122 is sleeved over the split retaining ring 120 and is captive within a cooperating bore 124 formed in the member 88. The clutch member 106 is also drivenly connected to the driving mandrel 86 by opposed radially-extending drive lugs 112, see FIG. 7, which are fitted in cooperating axially-extending slots 114 in the sleeve member 90.

Figure 8:
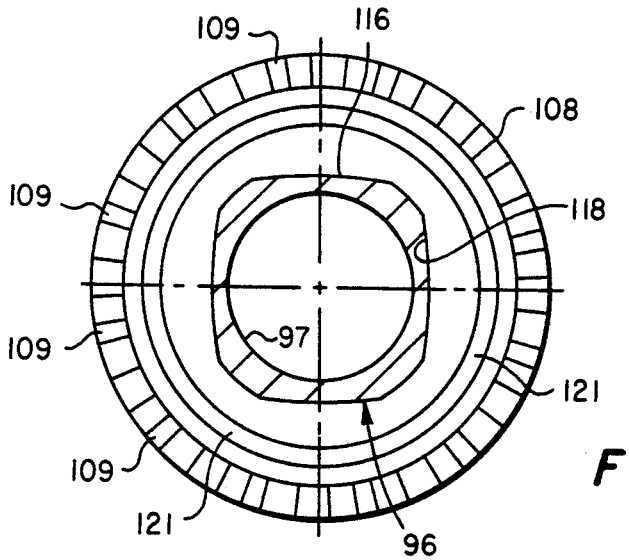
FIG. 8 is a view taken substantially from the line 8—8 of FIG. 6.
Figure 9:
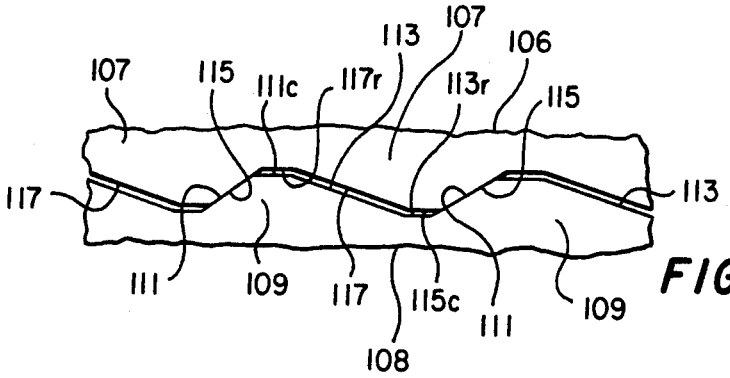
FIG. 9 is a detail view taken generally from line 9—9 of FIG. 6 showing a few of the cam lobes formed on the respective driving and driven clutch members.

The driven clutch member 108 is disposed on the mandrel 96 and is non-rotatably secured thereto by a polygonal cross-section part 116, FIG. 8, of the mandrel which fits in a cooperating polygonal bore 118 of the clutch member 108.

Figure 7:
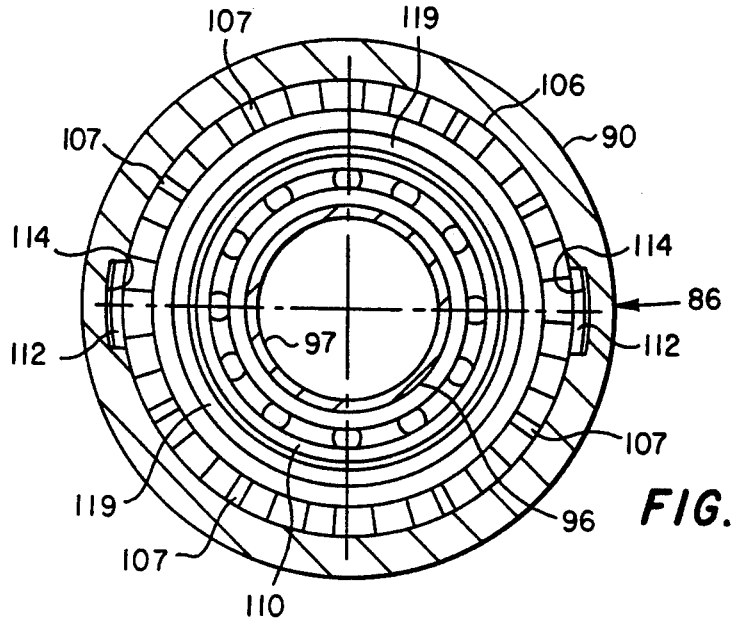
FIG. 7 is a view taken substantially from the line 7—7 of FIG. 6.

Referring further to FIGS. 6, 7 and 8, and FIG. 9, each of the clutch members 106 and 108 is provided with a set of circumferentially-spaced, axially-projecting, cooperating cam lobes 107 and 109, respectively. Each of the lobes 107 and 109 is preferably of the configuration illustrated in FIG. 9. Each of the lobes 109 have a driven surface 111 and a relief surface 113, respectively, as well as crown and root surfaces 111*c* and 113*r*. The lobes 107 include corresponding driving surfaces 115 and relief surfaces 117 together with corresponding crown and root surfaces 115*c* and 117*r*, and which may be of identical configuration and of the same hand. When the clutch members 106 and 108 are engaged with each other, as illustrated, the cooperating surfaces 111 and 115 are engaged with each other. These surfaces 111 and 115 are sloped so that, at a predetermined torque, reaction forces will force the clutch members 106 and 108 to move axially relative to each other and with respect to the longitudinal central axis 85, FIG. 6, to allow the driving mandrel 86 to rotate relative to the driven mandrel 96. Thanks to the plural spaced lobes 107, 109, the clutch members 106 and 108 constantly re-engage and slip relative to each other so that a predetermined limit torque is sustained as long as a sufficient torque is exerted on the work string 26 to rotate the mandrel 86 relative to the mandrel 96. The plural lobes 107 and 109 are equally spaced around the transverse faces of the clutch members 106 and 108 and may be of sufficient number, about 12, to distribute the loading and wear on the clutch members adequately. The clutch members 106 and 108 may be formed of tool steel with a hard facing disposed on the surfaces of the lobes 107 and 109, such as, for example, a titanium carbide coating or facing. Such a coating may be applied by conventional methods known in the art of hard surface, low friction coatings for metal parts. The clutch members 106 and 108 are also in engagement with each other along cooperating annular abuttment portions 119 and 121, as illustrated in FIGS. 6, 7 and 8 to limit the depth of interengagement of the lobes 107 and 109.

Referring again to FIG. 6, the clutch members 106 and 108 are biased into engagement with each other by a suitable back-to-back stack of conical spring washers 128 which are sleeved over the inner mandrel 96 and are interposed between the clutch member 108 and a support member 130. The support member 130 comprises a circular collar having a reduced diameter portion 131 engaged with a thrust bearing 132 which, in turn, is engaged with a somewhat cup-shaped piston 134 having an annular rim portion 136 which is sleeved over the support member 130, the driven clutch member 108 and engages the clutch member 106 at its distal end 139, FIG. 6. The maximum preload of the conical or Belleville type spring washers 128 exerted on the clutch member 108 to hold it engaged with the clutch member 106 may be predetermined by the dimensions of the member 130, the thrust bearing 132 and the piston 134, together with the number of spring washers 128 and the dimensions of clutch members 106 and 108. Accordingly, a predetermined maximum axial force may be exerted on the clutch member 108 to force it to engage the clutch member 106, which force is reached when the distal end 139 of the piston 134 engages the clutch member 106.

The piston 134 biases the clutch members 106 and 108 into engagement by way of the springs 128 under the urging of pressure fluid introduced into a cavity 140 formed between the mandrels 86 and 96 and extending substantially between the piston 134 and the end cap 94. A fluid such as a suitable hydraulic or lubricating oil may be pumped into the cavity 140 at a pressure sufficient to provide a predetermined biasing force on the piston 134 to urge the clutch members 106 and 108 into engagement at a predetermined engaging force. Moreover, the conical spring washers 128 have a force/deflection characteristic that permits a relatively constant maximum force to be exerted for a relatively large deflection beyond a predetermined initial deflection. Accordingly, movement of the clutch members, and variations in dimensions of the parts and working pressures may be accommodated without affecting the limit torque. The fluid may be introduced into the cavity 140 through ports in the member 90 which are provided with suitable commercially available quick disconnect type hydraulic couplings 144 which include suitable check valves interposed therein to prevent flow of fluid out of the cavity 140. The piston 134 may be provided with suitable seals to prevent fluid leakage between the piston and the mandrel 96 and between the piston and the piston bore 99 formed in the sleeve member 90. Suitable seals may also be disposed between the mandrel 96 and the end cap 94 and between the end cap and the sleeve member 92 to prevent fluid leakage out of the cavity 140 at the lower end of the device 84, viewing FIG. 6. The cavity which houses the clutch members 106 and 108 as well as the bearings 110 and which is formed between the piston 134 and the member 88 may also contain a quantity of a suitable lubricant or, conversely, the clutch members 106 and 108 may be self-lubricating, depending on the facing on the lobes 107 and 109. The bearings 110 may be self-lubricated and sealed, if desired.

The torque-limiting device 84 is also advantageously provided with a torsional deflection energy-absorbing mechanism similar to the device 34. The mandrel 96 includes an axially-extending key 146 suitably secured thereto and disposed in a cooperating keyway. The key 146 is engageable with an axially-translatable nut 148 having a suitable keyway 150 formed therein. The nut 148 is provided with suitable threads on its exterior surface engageable with threads 152 formed in a bore 151 of the sleeve member 92. Accordingly, the nut 148 is axially translatable but non-rotatable relative to the mandrel 96 while being rotatable and axially translatable relative to the mandrel 86. The nut 148 may be provided with axially-extending restricted passages communicating the chamber portion 141 with the chamber portion 143 so that, as the nut translates axially from the position shown to the alternate position shown in FIG. 6, in response to rotation of the driving mandrel with respect to the driven mandrel 96, fluid is forced through the nut from one side to the other. Alternatively, fluid may merely be forced through the clearance spaces formed between the nut 148 and the mandrel 96 as well as suitable clearance spaces formed between the cooperating threads on the nut and on the sleeve member 92.

The threads 152 terminate at the lower end of the sleeve member 92, viewing FIG. 6, as indicated at 153. Accordingly, the nut 148 may disengage from the threads 152 while remaining journalled in the bore 151 in the event that the torsional deflection in the drill string is such as to exceed the axial translation of the nut provided by the threads. In order to provide for reengagement of the nut 148 with the threads 152 to reset the device 84, a coil spring 160 is interposed between the lower bearing 98 and the nut, as shown, to bias the nut to reengage the threads 152 if it translates axially to the point of disengagement.

The device 84 has certain advantages with respect to the device 34. The clutch or coupling means formed by the members 106 and 108 and the biasing force urging the clutch members into engagement with each other as provided by the springs 128 allows the device 84 to reach a predetermined torque and permit rotation of the mandrel 86 with respect to the mandrel 96 without completely disengaging the torsional driving effort of the device 84 such as occurs with the device 34 when the shear pins 80 fail. The device 84 does not need to be disassembled to reset the torque-limiting mechanism or to change the predetermined torque at which the mechanism operates. Moreover, the pressure of fluid in the cavity 140 acting on the piston 134 may, if desired, be changed to modify the engaging forces between the clutch members 106 and 108 and the limit torque at which the clutch members rotate relative to each other.

Those skilled in the art will recognize that the torque-limiting mechanisms of the devices 34 and 84 may be utilized apart from the energy-absorbing mechanisms. In either of the devices, merely removing the axially-translatable nuts from the mechanism will render the energy absorption feature inoperable, although other structural changes might be practical for the design of a torque-limiting device only.

The devices 34 and 84 may be made of conventional materials used for downhole well tools and the like and including the materials mentioned for the clutch members 106 and 108. Upon assembly of the devices, the chambers 50 and 140 are filled with a suitable lubricating fluid, such as conventional machine grease or oil lubricant through a fitting 77, FIG. 2, or the check valve connectors 144, FIG. 6. Those skilled in the art will recognize that the devices 34 and 84, although quite useful in conjunction with an auger gravel pack assembly, may also be used in conjunction with other downhole tools or devices which are rotatably driven to perform their function and which should be torque-limited for one reason for another. Preferred embodiments of the invention have been described in detail herein. However, those skilled in the art will recognize that various substitutions and modifications may be made to the embodiments described without departing from the scope and spirit of the appended claims.

What is claimed is:

1. In an assembly for installing an auger gravel pack screen in a wellbore including an auger gravel pack screen, a workstring, and drive means for rotatably driving said workstring to auger said gravel pack screen into a gravel pack, the improvement characterized by:

a torque-limiting device interposed in said workstring, said torque-limiting device including a driving mandrel, a driven mandrel, and torque-limiting means interconnecting said mandrels and operable to limit the torque exerted on said auger gravel pack screen.

2. The invention set forth in claim 1 including:

torsional deflection energy-absorbing means for absorbing the energy of torsional deflection of said workstring when a limit torque is reached by said torque-limiting device.

3. The invention set forth in claim 2 wherein:

said torsional energy-absorbing means includes a member axially translatable along said mandrels and responsive to rotation of one of said mandrels relative to the other to effect energy absorption of torsional deflection of said workstring.

4. The invention set forth in claim 3 wherein:

said axially translatable member includes a nut threadedly connected to one of said mandrels and non-rotatable relative to, but axially movable along, the other of said mandrels, said nut being disposed in a chamber formed between said mandrels.

5. The invention set forth in claim 4 wherein:

said chamber is filled with a fluid and said nut includes means operable to throttle the transfer fluid from one part of said chamber to another in response to axial translation of said nut to absorb the energy of torsional deflection of said workstring.

6. The invention set forth in claim 1 or 2 wherein:

said torque-limiting device includes a driven part connected to said driven mandrel, a driving part connected to said driving mandrel, and shear pin means interconnecting said driving and driven parts and operable to shear at a predetermined torque acting on said torque-limiting device to permit rotation of said mandrels relative to each other.

7. The invention set forth in claim 6 wherein:

one of said parts is supported by and drivenly connected to one of said mandrels and the other of said parts is supported by and drivenly connected to the other of said mandrels and both of said parts are removable from said mandrels and replaceable by corresponding parts.

8. The invention set forth in claim 1 or 2 wherein:

said torque-limiting device includes a torque-limiting clutch including a driving member drivingly connected to said driving mandrel and a driven member engaged with said driving member and drivingly connected to said driven mandrel, and means for urging said clutch members into engagement with each other such that said clutch members slip relative to each other when a predetermined driving torque is exerted on said device.

9. The invention set forth in claim 8 wherein:

each of said clutch members includes cooperating cam lobes formed thereon and engageable with the cam lobes of the other clutch member to drivingly connect the clutch members and to permit rotation of the driving clutch member relative to the driven clutch member when said predetermined limit torque is reached.

10. The invention set forth in claim 8 wherein:

said clutch members are biased into engagement by spring means.

11. The invention set forth in claim 10 wherein:

said spring means comprises at least one conical spring washer.

12. The invention set forth in claim 10 including:

a piston disposed in a chamber formed between said driving mandrel and said driven mandrel and responsive to pressure fluid acting thereon to urge said spring means to hold said clutch members into engagement to prevent rotation of one of said clutch members relative to the other until said predetermined limit torque is reached during operation of said device.

13. The invention set forth in claim 1 wherein:

said device is disposed in said workstring between said drive means and said gravel pack screen such that a major part of said workstring extends between said device and said gravel pack screen.

14. A torque-limiting device adapted to be interposed in a rotatable drill stem or workstring for limiting the torque exerted on a downhole tool by said workstring, said device comprising:

a driving mandrel connected to said workstring and a driven mandrel connected to said workstring, said driving mandrel and said driven mandrel being operably connected for rotation relative to each other;

torque-limiting means responsive to a predetermined torque exerted between said mandrels to permit a limit torque to be reached by said workstring whereupon said torque limiting means is operable to permit rotation of one of said mandrels relative to the other of said mandrels; and a torsional deflection energy absorber for absorbing the energy of torsional deflection upon said torque-limiting device reaching a torque which will cause said torque limiting means to allow one of said mandrels to rotate relative to the other of said mandrels.

15. A torque-limiting device adapted to be interposed in a rotatable drill stem or workstring for limiting the torque exerted on a downhole tool by said workstring, said device comprising:

a driving mandrel connected to said workstring and a driven mandrel connected to said workstring, said driving mandrel and said driven mandrel being operably connected for rotation relative to each other; and torque-limiting means responsive to a predetermined torque exerted between said mandrels to permit a limit torque to be reached by said workstring whereupon said torque limiting means is operable to permit rotation of one of said mandrels relative to the other of said mandrels, said torque-limiting means including a driven part connected to said driven mandrel, a driving part connected to said driving mandrel, and shear pin means interconnecting said driving and driven parts and operable to shear at a predetermined torque acting on said torque-limiting device to permit rotation of said mandrels relative to each other.

16. The invention set forth in claim 14 wherein:

said energy-absorber includes a member axially translatable along said mandrels and responsive to rotation of one of said mandrels relative to the other to effect energy absorption of torsional deflection of said workstring.

17. The invention set forth in claim 16 wherein:

said axially translatable member includes a nut threadedly connected to one of said mandrels and non-rotatable relative to, but axially slidable along the other of said mandrels, said nut being disposed in a chamber formed between said mandrels.

18. The invention set forth in claim 17 wherein:

said chamber is filled with a fluid and said nut includes means operable to transfer fluid from one part of said chamber to another in response to axial translation of said nut to absorb the energy of torsional deflection of said workstring.

19. A torque-limiting device adapted to be interposed in a rotatable drill stem or workstring for limiting the torque exerted on a downhole tool by said workstring, said device comprising:

a driving mandrel connected to said workstring and a driven mandrel connected to said workstring, said driving mandrel and said driven mandrel being operably connected for rotation relative to each other; and torque-limiting means responsive to a predetermined torque exerted between said mandrels to permit a limit torque to be reached by said workstring whereupon said torque limiting means is operable to permit rotation of one of said mandrels relative to the other of said mandrels, said torque limiting means comprising a torque limiting clutch including a driving member drivingly connected to said driving mandrel and a driven member engaged with said driving member and drivingly connected to said driven mandrel, and means for urging said clutch members into engagement with each other such that said clutch members slip relative to each other when a predetermined driving torque is exerted on said device.

20. The invention set forth in claim 15 wherein:

one of said parts is supported by and drivenly connected to one of said mandrels and the other of said parts is supported by and drivenly connected to the other of said mandrels and both of said parts are removable from said mandrels and replaceable by corresponding parts.

21. The invention set forth in claim 19 wherein:

each of said clutch members includes cooperating cam lobes formed thereon and engageable with the cam lobes of the other clutch member to drivingly connect the clutch members and to permit rotation of the driving clutch member relative to the driven clutch member when said predetermined limit torque is reached.

22. A torque-limiting device for insertion in a rotatable drill string or work string for limiting the torque exerted on a downhole device such as an auger gravel pack assembly, said torque-limiting device comprising:

a driving mandrel adapted to be connected to said drill string, said driving mandrel comprising a member having a cavity formed therein;

a driven mandrel connected to said drill string and adapted to be rotatably driven by said driving mandrel and disposed at least partly in said cavity;

torque-limiting means responsive to a predetermined torque exerted between said mandrels to permit a limit torque to be reached by said drill string whereupon said torque-limiting means is operable to permit rotation of one of said mandrels relative to the other of said mandrels, said torque-limiting means comprising a generally cylindrical driving part disposed in said cavity and drivingly connected to said driving mandrel and a generally cylindrical driven part disposed in said cavity and drivingly connected to said driven mandrel, at least one shear pin interconnecting said parts and responsive to a predetermined torque exerted on said torque-limiting device to shear and permit rotation of said driving mandrel relative to said driven mandrel;

said driving mandrel including a first member and a second member, said second member comprising a generally tubular element removably connected to said first member and including means thereon for drivingly engaging said driving part;

said driven mandrel including a drive surface formed thereon and operable to support said driven part non-rotatably relative to said driven mandrel; and bearing means in said cavity for supporting said driving mandrel relative to said driven mandrel to permit rotation of said mandrels relative to each other.

23. The invention set forth in claim 22 including:

torsional energy-absorbing means comprising an axially-translatable nut disposed in said cavity and threadedly connected to one of said mandrels and axially slidable but non-rotatable relative to the other of said mandrels, said nut forming a fluid passage in said cavity between one side of said nut and the other side of said nut to permit restricted flow of fluid in said cavity from said one side to said other side of said nut upon failure of said shear pin to absorb torsional deflection energy in said drill string.

24. A torque-limiting device for inter-positioning in a drill string to limit the torque exerted on a downhole tool connected to said drill string, said torque-limiting device comprising:

a driving mandrel connected to said drill string and including a first member adapted to be connected to said drill string, a generally tubular sleeve member connected to said first member and forming part of said driving mandrel;

a driven mandrel connected at one end to said drill string and disposed for rotation relative to said driving mandrel;

bearing means interposed between said mandrels to permit relative rotation of said mandrels;

a torque-limiting clutch including a driving member drivingly engaged with said driving mandrel and a driven member drivingly engaged with said driven mandrel and means forming torque-limiting surfaces on said clutch members and engaged with each other to limit the torque exerted on said drill string by said device;

piston means disposed in said tubular member of said driving mandrel and operable to exert a biasing force to hold said clutch members engaged for transmission of torque between said driving and driven mandrels, and means operable to permit said clutch members to rotate relative to each other at a limit torque;

a cavity formed between said driving and driven mandrels;

means for introducing pressure fluid into said cavity to act on said piston to effect operation of said clutch at a predetermined limit torque.

25. The invention set forth in claim 24 including:

torsional deflection energy-absorbing means comprising an axially-translatable nut threadedly connected to one of said mandrels and axially translatable but non-rotatable relative to the other of said mandrels and responsive to rotation of one of said clutch members relative to the other of said clutch members to axially translate in said cavity to cause displacement of fluid from one side of said nut to the other to absorb torsional deflection energy of said drill string exerted on said device.

* * * * *